US012535290B1

(12) United States Patent
Christensen

(10) Patent No.: US 12,535,290 B1
(45) **Date of Patent: *Jan. 27, 2026**

(54) HOLSTER FACILITATING MASTER GRIP

(71) Applicant: Douglas J. Christensen, Medina, MN (US)

(72) Inventor: Douglas J. Christensen, Medina, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/753,983

(22) Filed: Jun. 25, 2024

Related U.S. Application Data

(63) Continuation of application No. 17/369,860, filed on Jul. 7, 2021, now Pat. No. 12,018,910, which is a continuation-in-part of application No. 16/698,501, filed on Nov. 27, 2019, now abandoned.

(60) Provisional application No. 62/771,700, filed on Nov. 27, 2018.

(51) Int. Cl.
*F41C 33/02* (2006.01)

(52) U.S. Cl.
CPC ..... *F41C 33/0236* (2013.01)

(58) Field of Classification Search
CPC ..... F41C 33/0209; F41C 33/0263; F41C 33/0227; F41C 33/0272
USPC ..... 224/196, 198, 192, 193, 243
See application file for complete search history.

(56) References Cited

U.S. PATENT DOCUMENTS 1,173,376 A * 2/1916 Noye ..... F41C 33/048 224/230
1,230,043 A * 6/1917 Shelton ..... F41C 33/0218 224/911
3,630,420 A * 12/1971 Bianchi ..... F41C 33/0227 224/193
3,718,240 A 2/1973 Rose
3,910,469 A 10/1975 Baldocchi
4,256,245 A 3/1981 Serres
4,298,150 A * 11/1981 Seldeen ..... F41C 33/0281 224/912
4,387,523 A 6/1983 Gallagher
4,689,908 A 9/1987 McClellan
5,100,036 A 3/1992 Rogers et al.
5,167,355 A * 12/1992 Hill ..... F41C 33/045 403/97
5,275,317 A 1/1994 Rogers et al.
5,284,281 A * 2/1994 Nichols ..... F41C 33/0263 224/244
5,372,288 A 12/1994 Rogers et al.
5,467,909 A * 11/1995 Resca ..... F41C 33/0245 224/198
5,570,830 A * 11/1996 Nichols ..... F41C 33/0236 224/679
5,598,958 A * 2/1997 Ryan, III ..... F41C 33/045 224/678

(Continued)

FOREIGN PATENT DOCUMENTS

DE 29602597 U 7/1996
WO WO2010064268 A1 6/2010

*Primary Examiner* — Nathan J Newhouse
*Assistant Examiner* — Lester L Vanterpool
(74) *Attorney, Agent, or Firm* — Christensen, Fonder, Dardi & Busse PLLC

(57) ABSTRACT

A polymer holster has an index finger slot on a distal wall portion of the holster for allowing a user to grip a handgun therein with a master grip before withdrawing the handgun therefrom. A thumb actuated release may be positioned on a proximal wall portion of the holster.

21 Claims, 8 Drawing Sheets

(56) References Cited

U.S. PATENT DOCUMENTS

| | | | | |
|---|---|---|---|---|
| 5,622,295 | A | 4/1997 | Hellweg et al. | |
| 6,112,962 | A | 9/2000 | Matthews | |
| 6,732,891 | B2 | 5/2004 | Locklear, III | |
| 6,948,644 | B1 | 9/2005 | Beletsky | |
| 7,140,523 | B2 | 11/2006 | Lowe et al. | |
| 7,258,259 | B1 | 8/2007 | Owens | |
| 7,461,765 | B2 * | 12/2008 | French | F41C 33/045 382/126 |
| 7,584,875 | B2 | 9/2009 | Lowe et al. | |
| 7,694,860 | B2 | 4/2010 | Clifton, Jr. | |
| 8,177,108 | B1 | 5/2012 | Kincaid et al. | |
| 8,602,275 | B1 | 12/2013 | Kiger et al. | |
| 8,631,981 | B2 | 1/2014 | Zusman | |
| 8,684,242 | B2 * | 4/2014 | Pomeroy | F41C 33/0227 224/198 |
| 8,720,755 | B2 | 5/2014 | Gregory et al. | |
| 8,851,344 | B2 * | 10/2014 | Baumann | F41C 33/0263 224/198 |
| 8,925,773 | B2 | 1/2015 | Clifton, Jr. | |
| 9,057,580 | B2 * | 6/2015 | Rorick | F41C 33/0263 |
| 9,109,857 | B2 | 8/2015 | Kendrick | |
| 9,134,093 | B2 | 9/2015 | Yeates | |
| 9,393,165 | B2 | 7/2016 | Pettigrew et al. | |
| 9,494,384 | B2 | 11/2016 | Rogers et al. | |
| 9,759,515 | B2 | 9/2017 | Yeates | |
| 10,018,447 | B1 * | 7/2018 | Alford | F41C 33/0272 |
| 10,330,435 | B2 | 6/2019 | McKendrick et al. | |
| 10,619,974 | B2 * | 4/2020 | Smith | F41C 33/0272 |
| 2003/0042279 | A1 * | 3/2003 | Locklear, III | F41C 33/0209 224/244 |
| 2005/0268518 | A1 * | 12/2005 | Pikielny | F41C 33/0236 42/90 |
| 2006/0011680 | A1 | 1/2006 | Cook et al. | |
| 2007/0163164 | A1 * | 7/2007 | Avrahami | F41C 33/04 42/87 |
| 2007/0170215 | A1 | 7/2007 | Evans et al. | |
| 2008/0110947 | A1 | 5/2008 | Pikielny | |
| 2010/0276464 | A1 | 11/2010 | Hirt et al. | |
| 2010/0299905 | A1 * | 12/2010 | McCoy | F41C 33/0236 29/428 |
| 2015/0369561 | A1 * | 12/2015 | Zdarsky | F41C 33/0263 224/243 |
| 2016/0069639 | A1 * | 3/2016 | Yeates | F41C 33/0272 224/243 |
| 2017/0276453 | A1 * | 9/2017 | Lance | F41C 33/0254 |
| 2019/0178609 | A1 * | 6/2019 | Horlacher | F41C 33/0209 |
| 2019/0293386 | A1 * | 9/2019 | Smith | F41C 33/0272 |

* cited by examiner

HOLSTER FACILITATING MASTER GRIP

CROSS-REFERENCE TO RELATED APPLICATIONS

This application is a continuation of U.S. Application No. 17,369,860, filed Jul. 7, 2021, now U.S. Pat. No. 12,018,910, said application was a continuation-in-part of U.S. application Ser. No. 16/698,501, filed Nov. 27, 2019, which claims priority to U.S. Provisional Application 62/771,700 filed Nov. 27, 2018. Said applications are incorporated herein by reference in their entireties.

BACKGROUND OF THE INVENTION

Holsters, particularly when used for law enforcement and military situations needs to be highly secure when holstered and reliably, intuitively, and safely unholstered in stressful situations ready for firing. When unholstered, the handgun is ideally in the master grip with the forefinger positioned on the handgun body above the trigger region. As the handgun is withdrawn and if the forefinger is not properly placed, the forefinger can migrate to the trigger region upon unholstering potentially causing an unintended discharge of the handgun.

SUMMARY OF THE INVENTION

Early handgun holster designs comprised pocket halves hand stitched together to form the handgun receiving pocket and with an attached leather belt. Retention means comprised gravity and potentially friction from the engagement between the pistol and leather pocket. Flexible leather straps or leather strips that extend over the exposed part of the handgun could secure the handgun in the holster. The early holster designs were primarily for revolvers.

The majority of holsters now utilize rigid polymer holster bodies and are made for receiving semi-automatic handguns having upper slides. The sidewalls of bodies that extend around the mass produced holsters have dramatically improved retention capabilities with different levels of retention available depending upon the need. One intended goal of such retention features is to prevent others from easily unholstering the handgun when in a struggle with the person wearing the holster and handgun, such as a law enforcement person. Holster retention capabilities are often categorized in three levels: level I, level II and level III. Level I typically equates to a conforming friction engagement for passive retention. Level II has an active mechanism that needs manual release to withdraw the handgun. Level III has two mechanical retention means for securing the handgun in the holster.

The manual release of the retention means is almost always by the same hand that grips and withdraws the holster, such as by an index finger or thumb release.

Conventional modern holsters typically have polymer housings that encompass the top, both sides, and the bottom of the handgun forward of the hand grip. Three fingers of the user's hand encircle the handgrip and the forefinger, the trigger finger and thumb extending forwardly with one or both of the thumb and index finger being used to actuate the holster release mechanism. When the handgun is withdrawn, the forefinger, and usually the thumb need to transition from a holster engagement position before withdrawal to a handgun engagement as the handgun leaves the holster.

Although holsters may have surface structure on the holster to direct the users forefinger to the correct location, even with such structure, upon withdrawal of the handgun and the transition of the forefinger from engaging the holster to engaging the handgun, the forefinger needs to move inward to engage the handgun. The transition can be problematic, particularly in stressful situations, grasping of the hand on the handgun can cause the forefinger positioning to shift moving to the trigger region. Any improvements in holsters to facilitate reliable and intuitive unholstering and facilitating the master grip when unholstered would be welcomed by users and the industry.

Allowing the index finger to engage the side of the handgun before the handgun is withdrawn from the holster provides a secure and stable master grip immediately as the handgun is withdrawn with the index finger pointing forward and resting on the side of the handgun above the trigger and trigger guard region. A feature and advantage of the holster is that there is no transition of the index finger from a holster engagement while the handgun is holstered to forefinger/handgun body engagement as the handgun is being withdrawn from the holster. A feature and advantage of embodiments is that when the handgun is gripped in the holster, it is gripped in the master grip and no transition of fingers is required as and after the handgun is unholstered.

A feature and advantage of embodiments is that the slot of the side of the holster provides positive tactile indication of where the index finger should be placed, the polymer housing defining the slot and the handgun frame within the slot, provides a locating feature that provides a high degree of certainty that the user will properly grip the handgun in the holster for a reliable and quick withdrawal.

A feature and advantage of embodiments is a textured, serrated, rough, beaded, bumped, or other non-smooth surface is provided at a lower margin of the forefinger slot to remind and cue the user to not lower the forefinger to the trigger area as the handgun is unholstered.

A feature and advantage of embodiments of the invention is a holster with a polymer injection molded body that that allows the user to engage the handgun when holstered with the user's index finger providing a stable, secure, and safe gripping of the handgun as it is withdrawn with no transition of the index finger from holster engagement to handgun engagement during the withdrawal process. In embodiments, a finger sized slot extends downward from an upper edge portion of the holster exposing the handgun at a portion of the handgun body intermediate between the slide and the trigger and trigger guard. In embodiments, the slot is defined by parallel or substantially parallel housing edge portions that extend downward toward the bottom of the holster and forwardly with respect to the handgun.

A feature and advantage of embodiments is a holster that provides near normal enclosure of the handgun by the holster while facilitating a secure withdrawal and master grip.

A holster with a slot for the index finger along the side of the weapon allowing handgun engagement along the holster body above the trigger guard when the handgun is still holstered facilitates the proper master grip when the holster is withdrawn.

A feature and advantage of embodiments is a holster body with a slot positioned at the index finger side of the holster body, the slot receiving inserts that can adjust the size of an elongate opening to the handgun body contained therein or close the slot.

A feature and advantage of embodiments is that the index finger is allowed to engage the body of the handgun before the complete withdrawal of the handgun from the holster, and wherein the distal wall portion precludes the index finger from reaching or engaging the trigger.

A feature and advantage of embodiments is that the holster allows complete extension of the index finger and contact with the handgun while the index finger is completely extended and before the handgun is withdrawn from the holster. A feature and advantage of embodiments is that the user may use one motion to reach downward to grasp the handgun allowing unholstering without altering the grasping of the handgun.

In embodiments of the invention, the slot for receiving the user's straightened index finger may have a cover or barrier thereover allowing insertion of the index finger below the cover or barrier.

A feature and advantage of embodiments of the invention, the distal phalanx and middle phalanx are in contact with the frame of the handgun prior to and as the handgun is being removed from the holster.

In embodiments, a holster in combination with a semiautomatic handgun having an upper slide, when the handgun is holstered, the holster has a slot extending from the rearward end of the holster forwardly and configured and sized for a user's forefinger and positioned to place the user's forefinger on the body of the handgun below the slide and above the trigger region. The slot extending at least the length of the distal phalange of the forefinger. The slot upper margin positioned at or below a juncture of the slide and the body of the handgun, the slot lower margin positioned above the trigger region on the body of the handgun. In embodiments, the handgun has a rib positioned above the trigger guard region, the rib exposed when the handgun is holstered such that the user's forefinger can engage the rib providing a reminder and cue to hold the forefinger in place on the body of the handgun as the handgun is unholstered.

DETAILED DESCRIPTION

Figure 1:
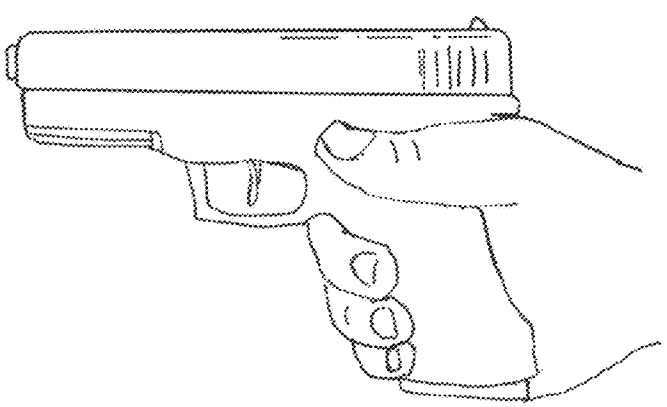
FIGS. 1 and 2 illustrate a master grip.
Figure 2:
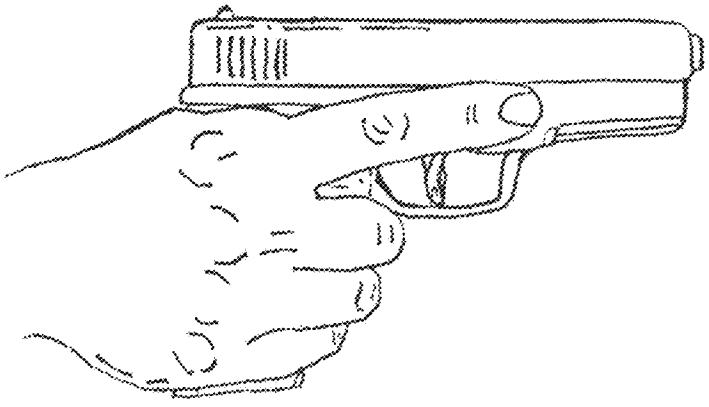
Figure 3:
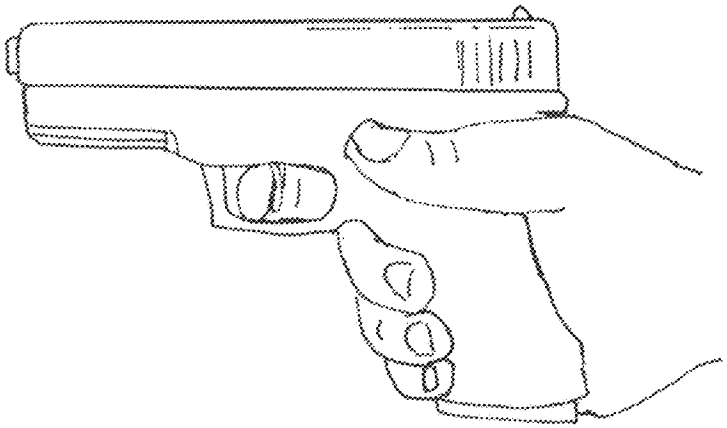
FIGS. 3 and 4 illustrate the master grip transitioned to a ready to fire position with the index finger on the trigger.
Figure 4:
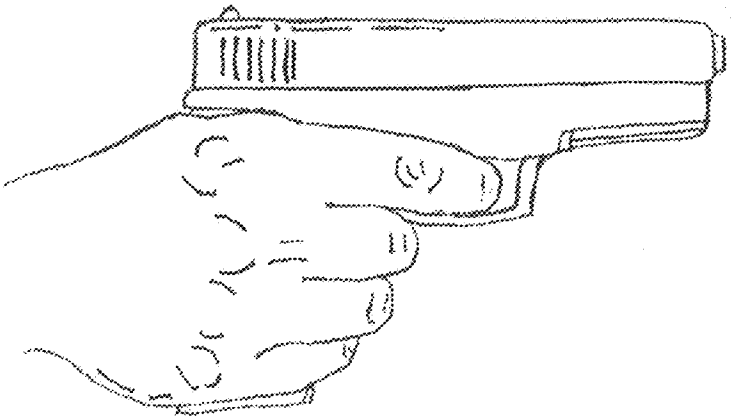

Referring to FIG. 1-2 the well known "master grip" for gripping handguns is illustrated with the users forefinger on the body of the handgun above the trigger region. FIGS. 3-4 illustrate the ready-to-fire grip with the finger at the trigger.

Figure 5A:
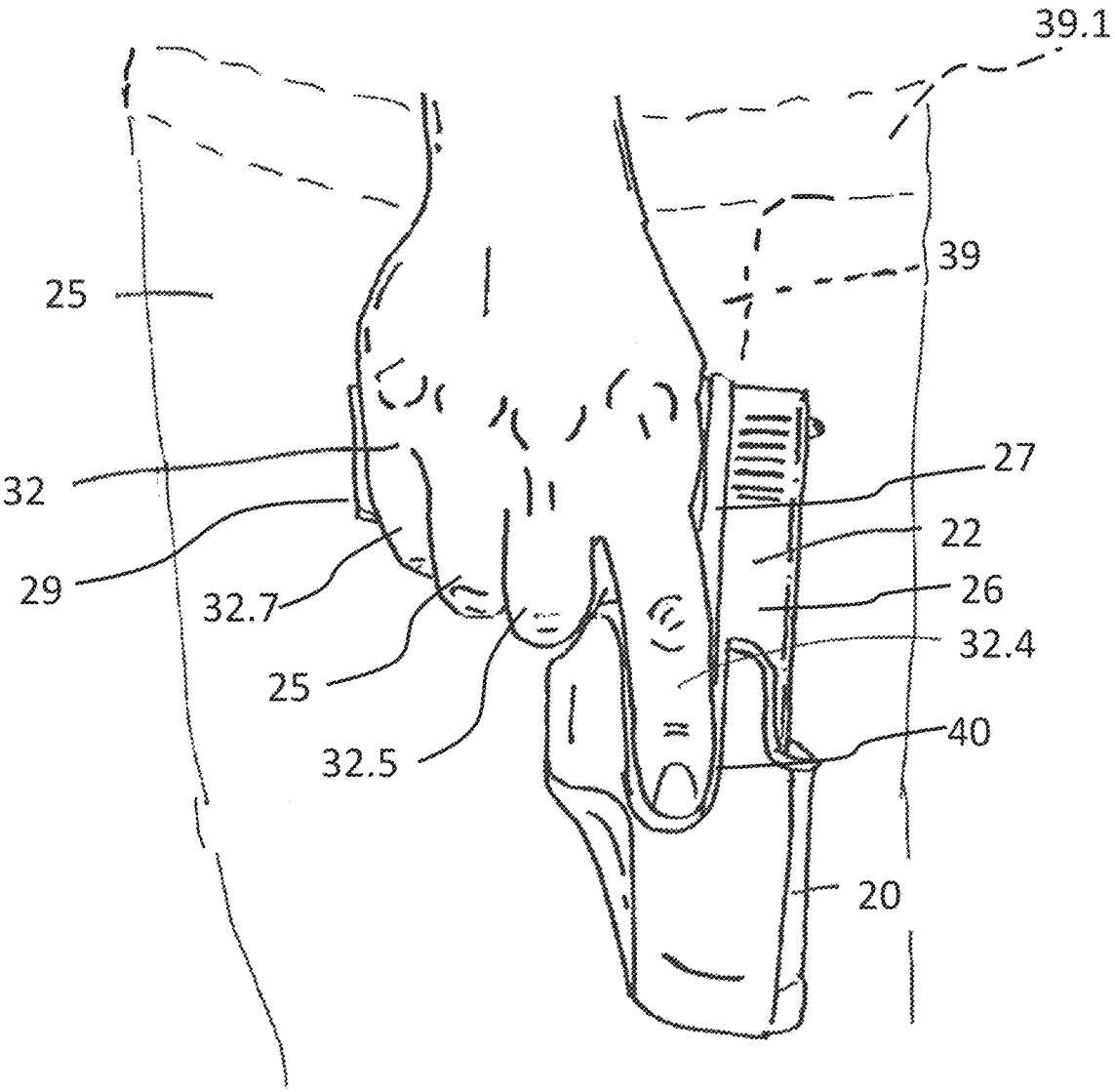
FIG. 5A illustrates a holster in accord with embodiments having a handgun therein gripped by a user, the user gripping the handgun with the master grip.
Figure 5B:
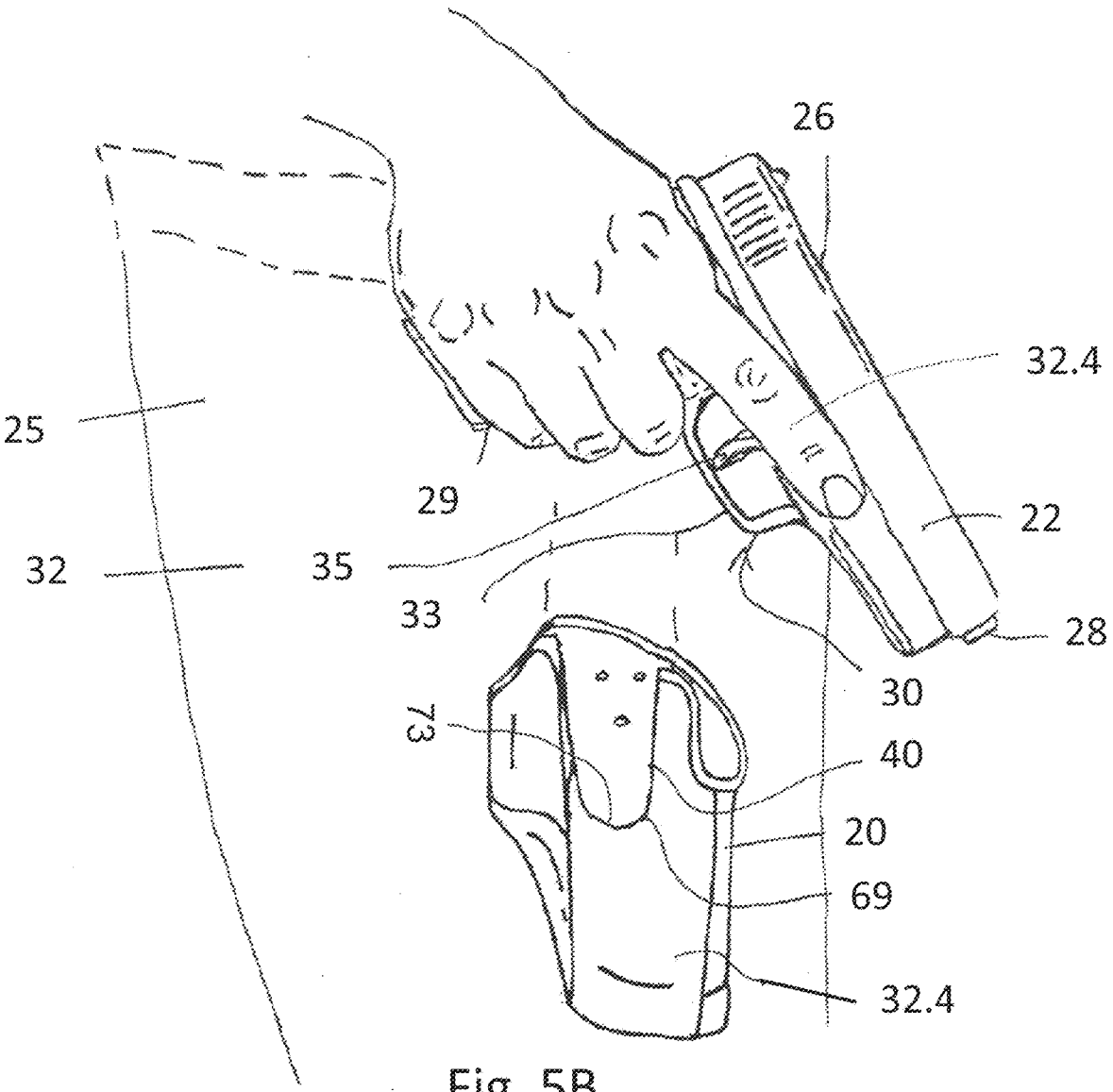
FIG. 5B illustrates the holster and handgun of FIG. 5A with the handgun withdrawn and with the handgun being grasped in the master grip.

Referring to FIGS. 5A and 5B, a holster 20 with a handgun 22 therein being worn by a user 25. The handgun being a semiautomatic handgun with an upper slide 26 on a body 27, a barrel 28, a grip 29, a trigger region 30, with a trigger guard 33 and a trigger 35. The holster secured to the user by conventional attachment means 39, such as a strap, for securing the holster to the user's belt 39.1 or elsewhere. The user gripping the handgun with his hand 32 with the master grip prior to withdrawal of the holster from the handgun. The user's forefinger 32.4 is positioned in a master grip forefinger slot 40 of the holster, the middle finger 32.5, the ring finger 32.6 and the little finger 32.7 are wrapped around and are gripping the grip 29. The user's forefinger 32.4 is pressed against the handgun body 27 between the upper slide 26 and the trigger region 30.

Figure 6:
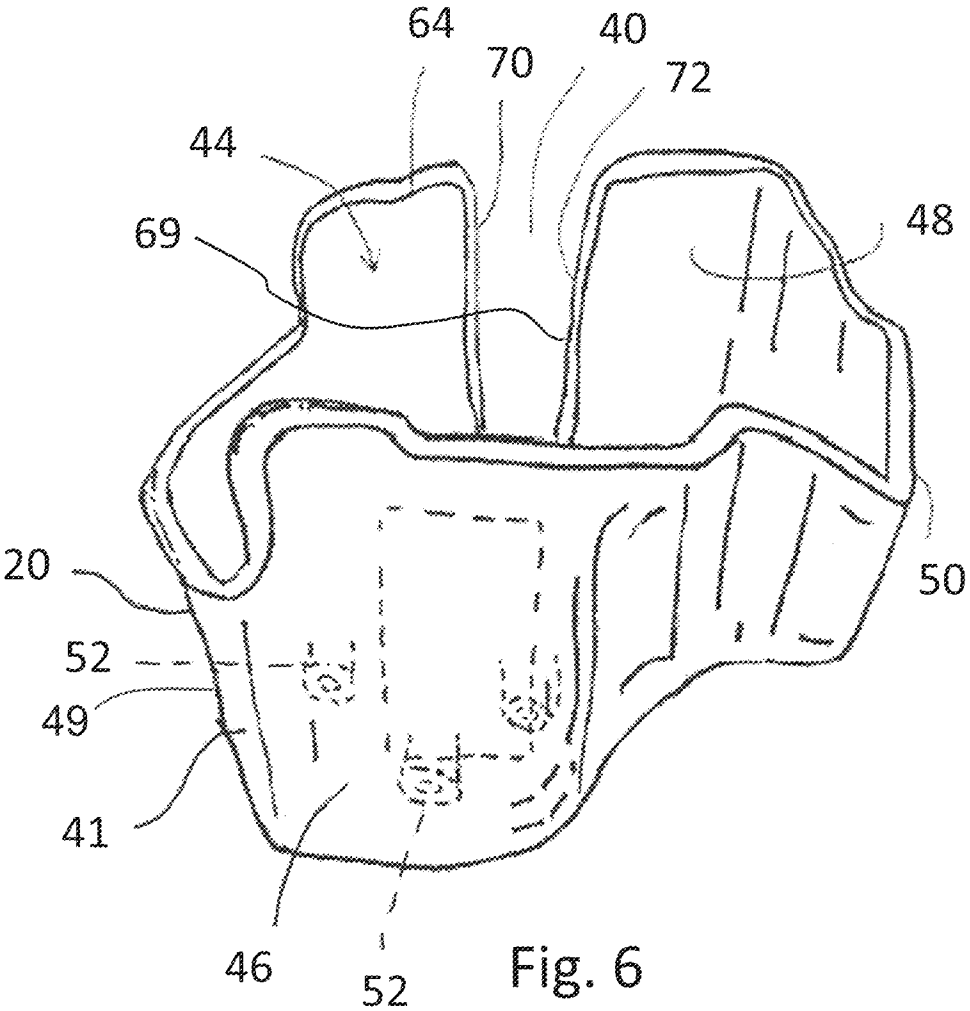
FIG. 6 is a perspective view of the holster of FIG. 5 from a rear view.

Referring to FIGS. 5B and 6 the holster body 41 is illustrated and has a rigid polymer housing 42 defining a handgun receiving cavity 44 therein. Opposing sidewall portions 46, 48 are connected by a forward wall portion 49 and a rearward wall portion 50. Attachment bosses 52 are for connecting the holster to a suitable mounting system. The holster sidewall away from user when worn, the distal sidewall 48, has the master grip forefinger slot 40 therein that extends downward, with respect to a holster being worn by the user standing, or forwardly with respect to the handgun, or when the user is sitting, from the upper margin 64 of the holster. The forefinger slot defined by a slot defining margin 69, including a forward and rearward margins or edge portions 70, 72 and a curved end margin 73 at the user's forefinger tip and being generally sized for and configured for the user's forefinger 32.4. The slot may extend one inch or more into the distal side wall from the upper margin and can accommodate, in embodiments, at least the distal phalange of the user's forefinger. In embodiments the slot may be up to 3.75 inches measured from the upper margin forward of the slot to the lowest end of the slot. In embodiments the slot may be up to 3.25 inches measured from the upper margin forward of the slot to the lowest end of the slot. The forward margin and rearward margin may be generally straight and may be parallel or within 30 degrees of parallel in embodiments. In embodiments, the forward margin and rearward margin may be substantially straight and be angled with respect to each other of 25 degrees or less.

Figure 7:
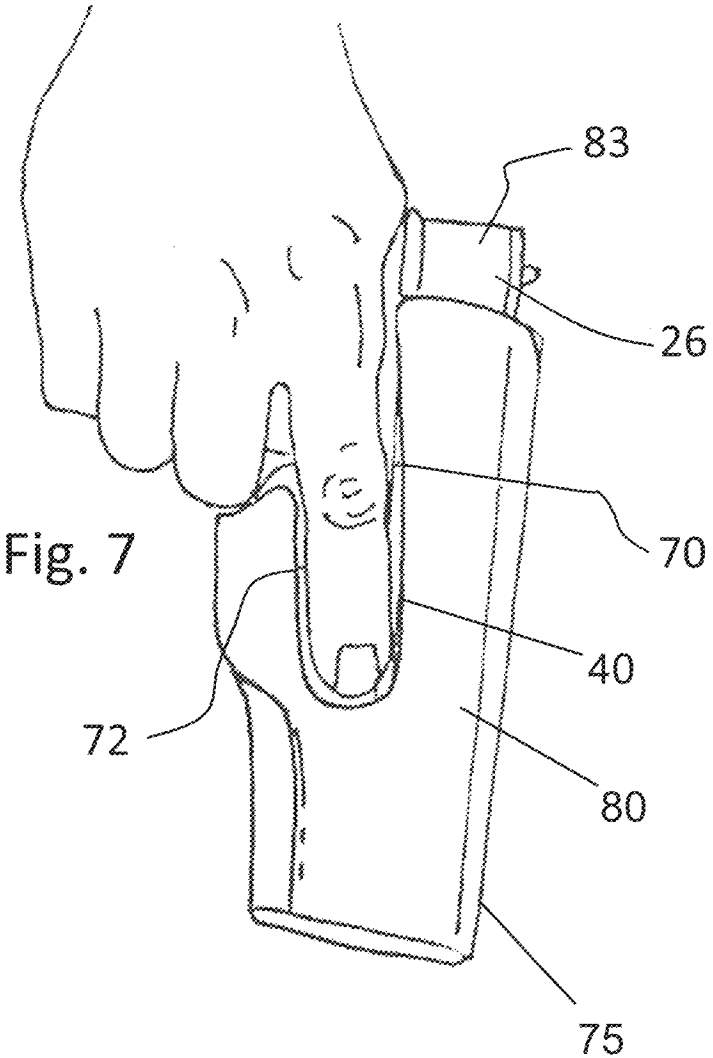
FIG. 7 is a side view of another holster embodiment, the holster having a handgun therein gripped by a user, the user gripping the handgun with the master grip.

Referring to FIG. 7, another holster 75 with a master grip forefinger slot 40 is illustrated and has a forward margin 70 significantly longer than the rearward margin 72. The holster has a body 80 that extends proximate the rearward end 83 of the slide 26.

Figure 12:
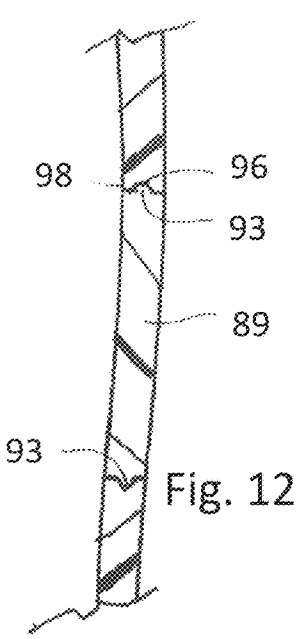
FIG. 12 is a cross-sectional view taken at line 12-12 of FIG. 10.
Figure 11:
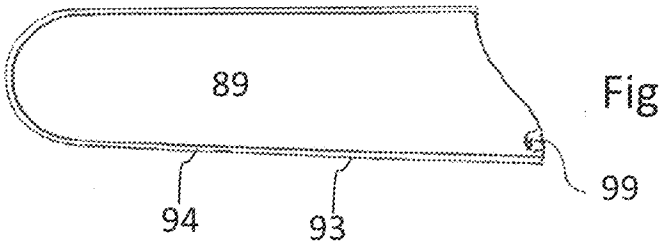
FIG. 11 is a side view of the insert of FIG. 10.

The rigid holster with the forefinger slot is particularly amenable to holsters with thumb actuation buttons. Such buttons may require depressing toward the handgun or pushing a pad forwardly. Referring to FIGS. 8-14, a holster 87 with a master grip forefinger slot 40, having an insert 89 inserted therein, and having a thumb actuated release mechanism 90 are illustrated. As best shown in FIGS. 10-12, the insert 89 may have a central protrusion or rib 93 extending along the insert margin 94 that interfaces with a groove 96 extending along the slot defining margin 98 of the distal wall portion of the holster. A nub 99 or gripping feature may aid in removal of the insert from the master grip forefinger slot 40.

Figure 9:
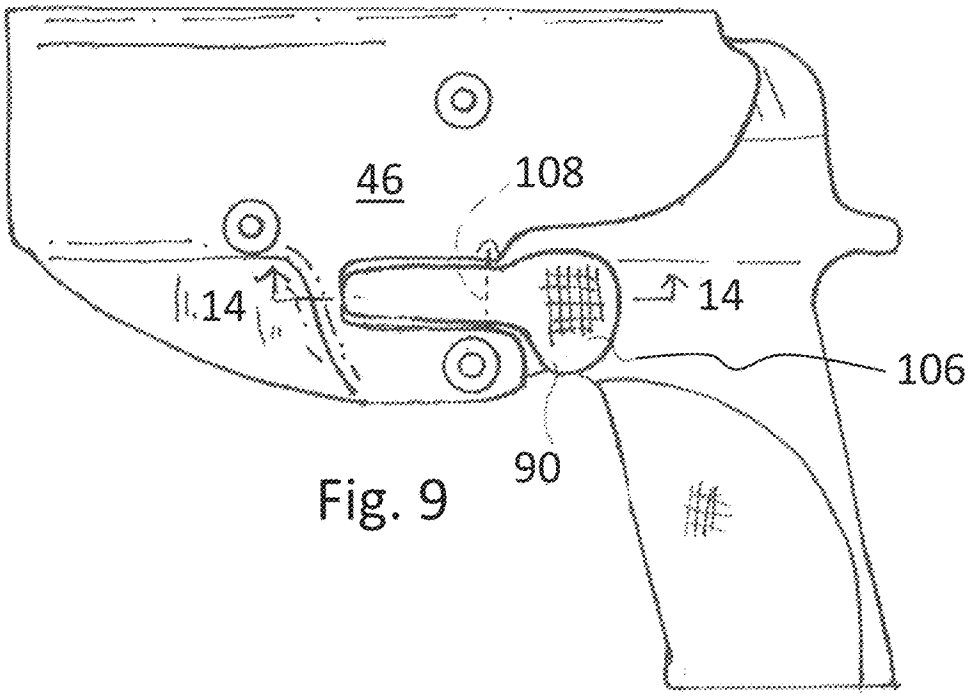
FIG. 9 is the semiautomatic handgun with a slide holstered in a holster of FIG. 8, with a thumb actuated release.
Figure 8:
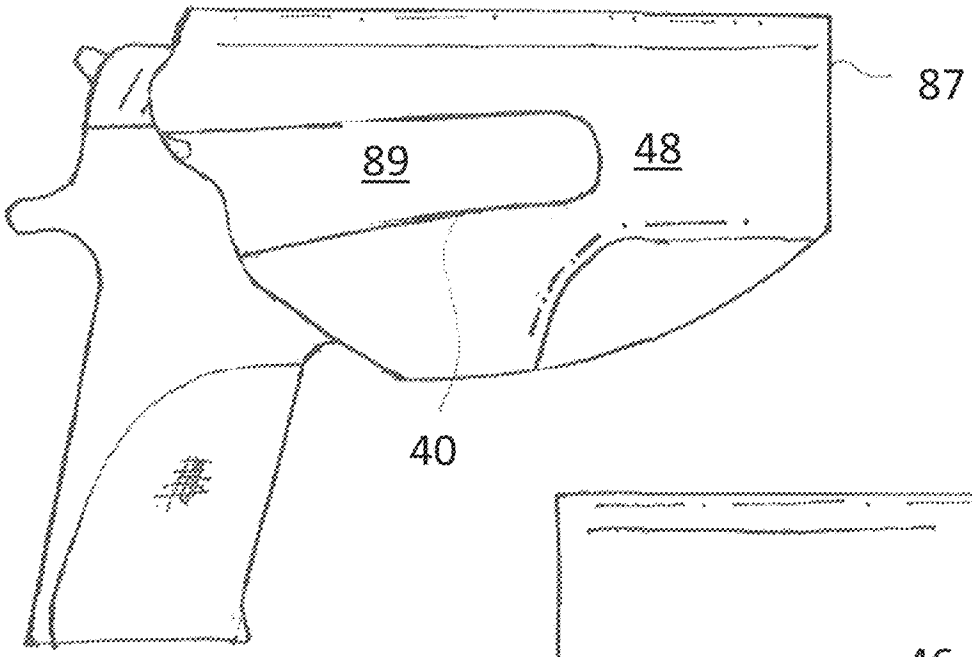
FIG. 8 illustrates a semiautomatic handgun with a slide holstered in a holster with a forefinger slot, the slot having an insert closing the slot.
Figure 13:
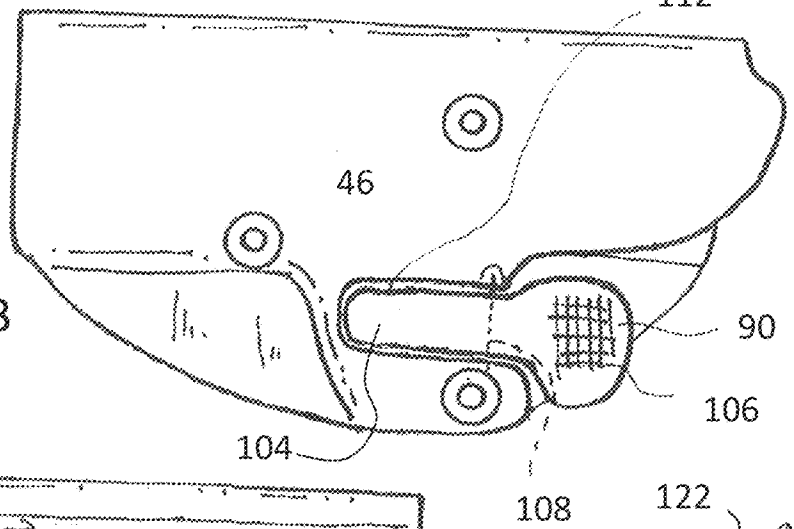
FIG. 13 is a side elevation view of the holster of FIG. 13.
Figure 14:
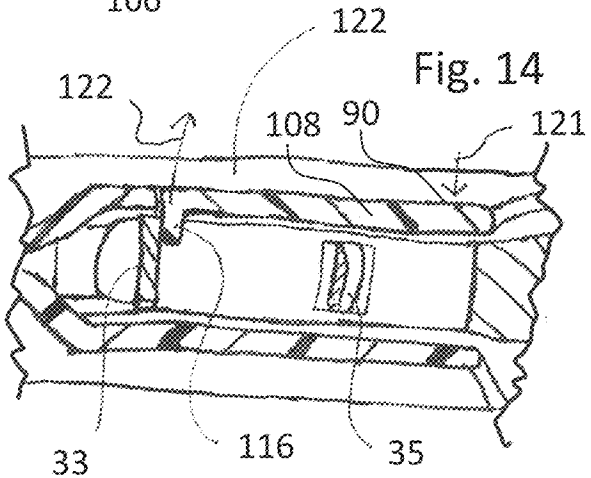
FIG. 14 is a cross-sectional view taken at line 14-14 of FIG. 9.
Figure 10:
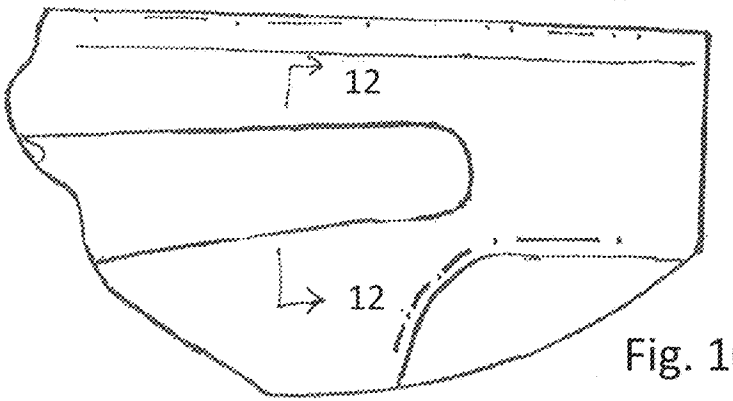
FIG. 10 is a side elevation view of a holster with a forefinger master grip slot with a insert therein.

Referring to FIGS. 9, 13, and 14, the thumb actuated release mechanism 90 is illustrated. A lever 104 with a thumbpad 106, pivots about a pin 108 in a conforming recess 112 in the proximal sidewall portion 46. The lever has a stop portion 116 that in a normal position obstructs the removal of the handgun by blocking the trigger guard 33. Depression of the thumbpad 90 as indicated by arrow 121 pivots the lever about pin 108 and moves the stop portion 116 outwardly, as indicated by arrow 122, to a non-obstructing position allowing removal of the handgun from the holster. Other known release mechanisms may also be utilized. See for example, U.S. Patents and Publications: U.S. Pat. Nos. 9,134,093, 8,602,275, 9,759,515, and 2019/0293386. All incorporated by reference herein for all purposes.

Figure 15:
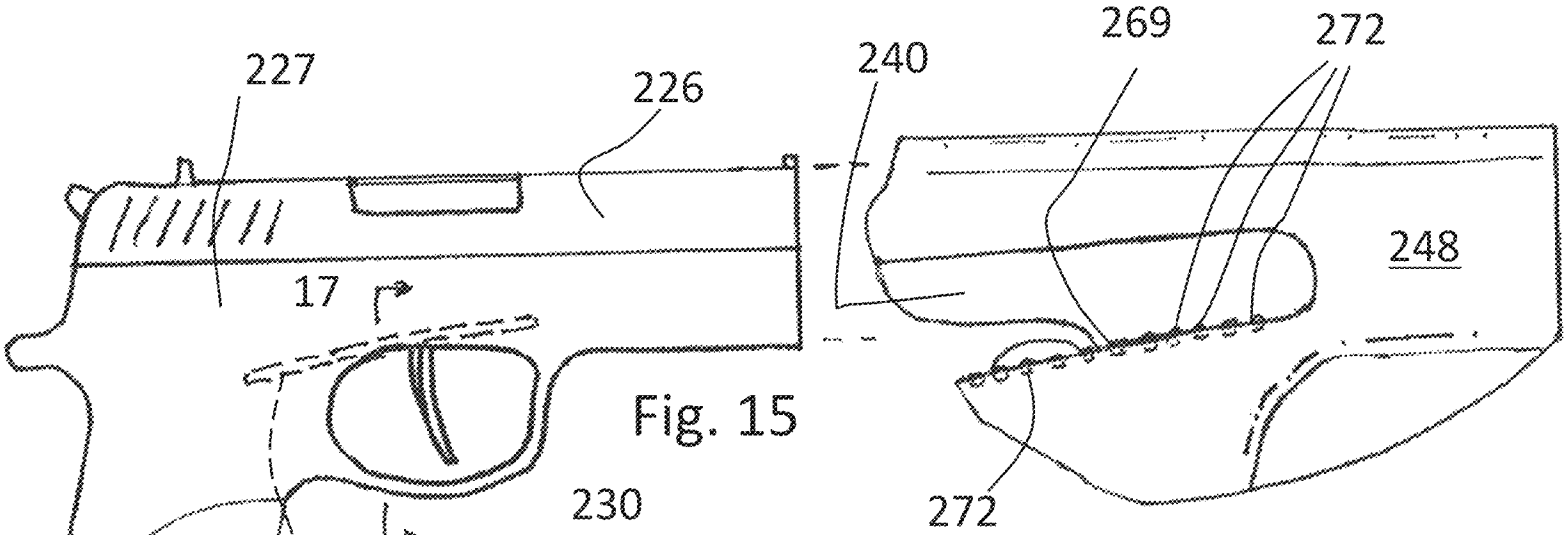
FIG. 15 is a side elevation view of a combination semiautomatic handgun with a slide and a holster having a master grip forefinger slot with a non-smooth lower margin at the slot.
Figure 16:
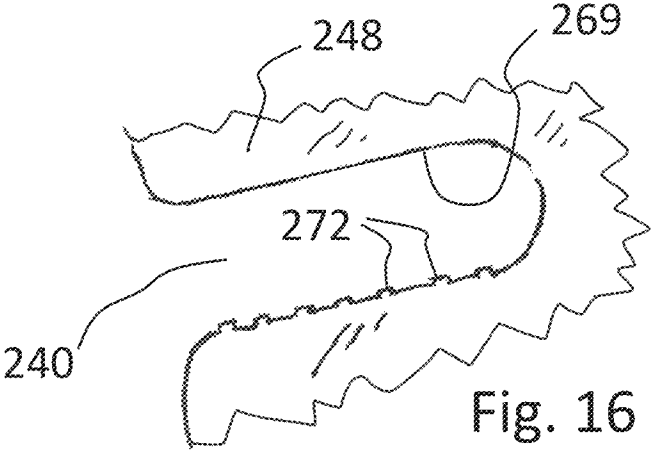
FIG. 16 is a side elevational view of another embodiment of the slot with the lower margin having a serrated edge.
Figure 17:
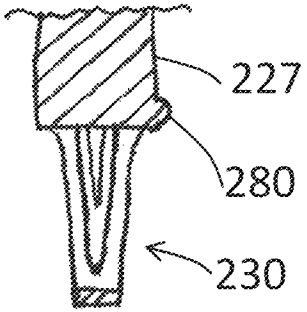
FIG. 17 is a cross-sectional view taken at line 17-17 of FIG. 15 illustrating a rib defining the lower margin of the forefinger placement on the handgun.

Referring to FIGS. 15-17, a handgun 222 and holster 220 with a master grip forefinger slot 240 with additional features are illustrated. In embodiments, the margin 269 defining the forefinger slot in the distal sidewall portion 248 may have projections 272 or non-smooth features to providing a reminder or cue to the user to maintain, that is freeze, his forefinger on the body 227 of the handgun between the slide 226 and the trigger region 230 as the handgun is being withdrawn. The non-smooth features may provide a scrapping or tactile sensation that can aid in freezing the master grip position of the forefinger, discouraging premature migration of the forefinger to the trigger region. The handgun may also have a rib 280 projecting from the handgun body 227 that can further operate as a cue or reminder to maintain the forefinger in the master grip position between the handgun slide and trigger region on the handgun body. The rib providing a physical obstruction to moving the forefinger to the trigger region. The rib 280 may be aligned with the master grip forefinger slot 240 and may be utilized with or without the non-smooth features on the slot defining margin 269.

The invention claimed is:

1. A holster for receiving a handgun, the holster comprising:

a rigid polymer holster body defining a handgun receiving cavity, wherein when worn by a standing user, the holster body having a user adjacent proximal wall portion, an opposite distal wall portion, a forward wall portion extending between the proximal wall portion and the distal wall portion, and a rearward wall portion extending between the proximal wall portion and the distal wall portion, the holster body open upwardly for receiving and withdrawing of the handgun;

wherein when the handgun is holstered, the distal wall portion defining an index finger slot contiguous with an upper opening of the handgun receiving cavity and extending downwardly with respect to the holster and along the body of the handgun forward of the trigger guard and trigger allowing the user's index finger to fully extend and contact the side of the holstered handgun for the length of the user's index finger, and wherein the distal wall portion extends over the trigger guard and trigger precluding the index finger from reaching or engaging the trigger of the holstered handgun.

2. The holster of claim 1, wherein the index finger slot being defined by slot edge portions conformingly shaped for receiving the user's index finger.

3. The holster of claim 1, wherein the slot for receiving the user's index finger is defined by a forward margin and a rearward margin, and the forward and reward margins are parallel or within 30 degrees of parallel.

4. The holster of claim 1, wherein the holster further comprising a handgun release mechanism connected to the holster body, the release mechanism including a finger engaging release lever positioned below the upper opening.

5. The holster of claim 4, wherein the finger engaging release lever includes a thumb engaging pad positioned at the proximal wall portion of the holster body.

6. The holster of claim 5, wherein the thumb engaging pad is depressed inwardly for actuating the release mechanism.

7. A holster comprising a rigid polymer holster body with an open upper end for receiving a handgun, wherein the handgun has a handgun body, a handgrip extending from the handgun body, a slide on the handgun body, and a trigger and trigger guard extending from the handgun body opposite the slide, the holster body sized to the handgun, with a proximal wall portion sized to extend along and cover a portion of one side of the handgun when the handgun is holstered from the slide to the trigger guard, a distal wall portion sized to extend along and cover a portion of the other side of the handgun from the slide toward the trigger guard and having an index finger slot, the distal wall portion further sized to extend along the other side of the handgun from a rearward edge portion to the trigger guard and covering the trigger guard and trigger wherein the user may position an index finger along the handgun body at the other side forward of the rearward edge portion of the holster body and forward of the trigger and trigger guard, and wherein the user may wrap three fingers about the handgrip, and wherein the distal wall portion precludes the index finger from reaching the trigger.

8. The holster of claim 7, wherein the index finger slot is sized to the user's index finger.

9. The holster of claim 7, wherein the index finger slot extends one inch or more from an upper margin of the holster.

10. The holster of claim 7, wherein the holster further comprising a release mechanism connected to the housing body, the release mechanism including a finger engaging release lever positioned below the upper opening.

11. The holster of claim 10, wherein the finger engaging release lever includes a thumb engaging pad positioned at the proximal wall portion of the holster body.

12. The holster of claim 11, wherein the thumb engaging pad is depressed inwardly for actuating the release mechanism.

13. The holster of claim 8, wherein the rearward edge portion defining the index finger slot has structure projecting therefrom providing a non-smooth surface at the edge.

14. The holster of claim 7, in combination with the handgun.

15. A holster for receiving a handgun with a slide, a handgun body, a trigger, and a trigger guard extending from the body at a trigger region, the holster having a master grip index finger receiving slot shaped for receiving the user's index finger whereby the user may grip the holstered handgun in the master grip with the user's fully extended index finger placed on the side of the handgun contacting the handgun body, the index finger pointing forwardly on the handgun as the user grips the holstered handgun, the holster extending over the trigger region precluding the user's forefinger from reaching the trigger of the holstered handgun.

16. The holster of claim 15, wherein master grip index finger receiving slot is sized for the user's index finger.

17. The holster of claim 16, further comprising a retention means with a finger actuatable release.

18. The holster of claim 15, comprising a holster body with an open upper end for receiving the handgun, the holster body shaped to the handgun, with a proximal wall portion sized to extend along and cover one side of the handgun from the handgun slide to the trigger guard, covering the trigger and trigger guard, a distal wall portion conformingly sized to extend along and cover the other side of the handgun from the slide to a forward margin of the master grip index finger receiving slot, the distal wall portion further conformingly sized to extend along the other side of the handgun from a rearward margin of the master grip index finger receiving slot to the trigger guard and extending over the trigger guard.

19. The holster of claim 18, wherein the master grip index finger receiving slot is defined by a straight forward margin extending from the open upper end, the straight forward margin extending to a curved lower margin, and a straight rearward margin extending from the curved lower margin to the open upper end.

20. The holster of claim 15, wherein the master grip index finger receiving slot is defined by a straight forward margin extending from an open upper end to a curved lower margin, and a straight rearward margin extending from the curved lower margin to the open upper end.

21. The holster of claim 15, whereby when the handgun is unholstered and pointed forwardly, the user's hand is in the master grip with no transition of fingers after the unholstering the handgun.

* * * * *